United States Patent [19]

Schieppati et al.

[11] Patent Number: 5,029,899

[45] Date of Patent: Jul. 9, 1991

[54] PROTECTIVE, REMOVABLE BOOK COVER WITH TRANSPARENT MARKING OVERLAYS

[76] Inventors: Patrice D. Schieppati; Daniel A. Schieppati, both of 3181 Madeira Ave., Costa Mesa, Calif. 92626

[21] Appl. No.: 415,564

[22] Filed: Oct. 2, 1989

[51] Int. Cl.[5] ..... B42D 3/00

[52] U.S. Cl. ..... 281/30; 281/3.1; 281/31

[58] Field of Search ..... 281/30, 31, 33, 34, 281/35, 51, 15.1, 3.1; 434/88, 150, 348

[56] References Cited

U.S. PATENT DOCUMENTS

| | | | |
|---|---|---|---|
| 1,407,239 | 2/1922 | Weiss | 281/51 |
| 1,510,110 | 9/1924 | Schmidt | 434/150 |
| 2,075,529 | 3/1937 | Leubrie | 434/88 |
| 2,791,040 | 5/1957 | Santorelli | 434/150 |
| 3,492,743 | 2/1970 | Schmidt | 434/88 |
| 4,451,067 | 5/1984 | Williams | 281/31 |
| 4,497,508 | 2/1985 | McHugh | 281/34 |
| 4,566,721 | 1/1986 | Friedman et al. | 281/30 |

*Primary Examiner*—Mark Rosenbaum
*Assistant Examiner*—Hwei-Siu Payer
*Attorney, Agent, or Firm*—J. Mark Holland; Thomas P. Mahoney

[57] ABSTRACT

A removable, protective book cover is provided which includes a jacket portion removably mountable in operative relationship with the binding of a book and having transparent overlay sheets secured thereto which may be disposed in operative relationship with the relevant pages of the book with which the cover is associated, said sheets incorporating hinges which facilitate the juxtaposition of the underside of the transparent overlay sheets in operative relationship with the relevant pages of the book so that maximum perception of the printed or other material on the page may be achieved by the person utilizing the book. Retaining element is provided to retain the cover in a desired closed, protective configuration between periods of usage.

10 Claims, 2 Drawing Sheets

PROTECTIVE, REMOVABLE BOOK COVER WITH TRANSPARENT MARKING OVERLAYS

BACKGROUND OF THE INVENTION:

This invention relates to book covers of the character which are utilized to provide protection for the binding of a book and further characterized by the fact that they may be readily installed upon or removed from the binding of said book. Furthermore, the removable, protective book cover of the invention is characterized by the provision of one or more transparent overlays secured in operative relationship with said cover whereby said overlays may be disposed in operative relationship with said book, and being transparent, may be utilized to make temporary notations upon the surface thereof relevant to the subject matter of the page with which said overlay or overlays are associated.

Illustrative of the utilization of the device of my invention is its association with a conventional map book consisting of a plurality of sectional maps devoted to a particular geographic area such as a county, city, or state and consisting of a plurality of pages suitably bound in operative relationship whereby contiguous pages may be disposed in side to side relationships. Map books of this character are customarily intensively used by sales persons and individuals whose occupations entail frequent recourse to such map books to ascertain the location of their destinations which may be the offices of customers or the like.

Since the maps incorporated in conventional map books are imprinted on relatively fragile paper, making notations or inscriptions thereupon will ultimately obscure the surface of the map page and result in limited utility of the relevant section of the book.

Therefore, the provision of the overlays in conjunction with the removable cover of the invention eliminates this undesirable consequence of making notations on the surface of the map itself since relevant notations can be made upon the surface of the transparent overlay.

Frequently, it is necessary to utilize two map sections in conjunction with each other, and the provision of a plurality of overlays, secured to opposite edges and/or to the same edge of the cover of my invention, permits the overlays to be disposed in operative relationship with the relevant surfaces of the map sections being utilized with corresponding notations thereupon.

Prior art overlays intended to be utilized with an imprinted surface are disclosed in U.S. Pat. Nos. 2,791,040 and 1,510,110. The U.S. Pat. No. 2,791,040 teaches of the provision of a transparent envelope in which a drawing or other imprinted material can be installed, with notations being made upon the transparent portion of the envelope, while the U.S. Pat. No. 1,510,110 teaches a book binding having a permanent overlay associated with one edge thereof.

Among other things, overlays in prior art devices tend to "gap" away from the pages of the book, making it difficult to transfer information from the page to the overlay. This problem is exacerbated for thick books, and is particularly acute when the overlay is used on pages which are relatively far away from the cover of such a book, or when the desired information is at the outer edges of the pages of the book.

OBJECTS AND ADVANTAGES OF THE INVENTION:

It is, therefore, an object of my invention to provide a removable, protective book cover characterized by the incorporation in operative relationship therewith of one or more overlays of a transparent nature which can be juxtaposed to the surface of a relevant page of the book to permit notations to be inscribed thereupon, which notations are derived from the imprinted material appearing on the surface of the relevant page and are easily erased or removed from such overlay.

Another object of my invention is the provision of hinge means integrally formed in the material of said overlay adjacent the point of securement of said overlay or overlays whereby the overlay or overlays may be disposed more readily in intimate juxtaposition to the surface of the page with which the overlay or overlays are being utilized, to eliminate the "gapping" problems of prior art devices.

A further object of my invention is the provision of a map book cover of the aforementioned character wherein the removable book cover incorporates securement means permitting the removable affixation of the cover in operative relationship with a selected book. Therefore, when the book with which the cover is being utilized has been outdated, as is frequently the case with map books of the aforementioned character, the cover can be removed and installed upon a new edition of the map book.

An additional object of my invention is the provision of a protective cover of the aforementioned character wherein the means of mounting or securing the cover in operative relationship with the book consists of pockets and said pockets have the transparent overlays secured in operative relationship therewith.

Another object of my invention is the provision of a protective cover of the aforementioned character wherein the cover includes retaining means to retain the cover in a desired closed, protective configuration between periods of usage.

Other objects and advantages of the invention will be apparent from the following specification and the accompanying drawings.

DESCRIPTION OF PREFERRED EMBODIMENTS OF THE INVENTION

Figure 1:
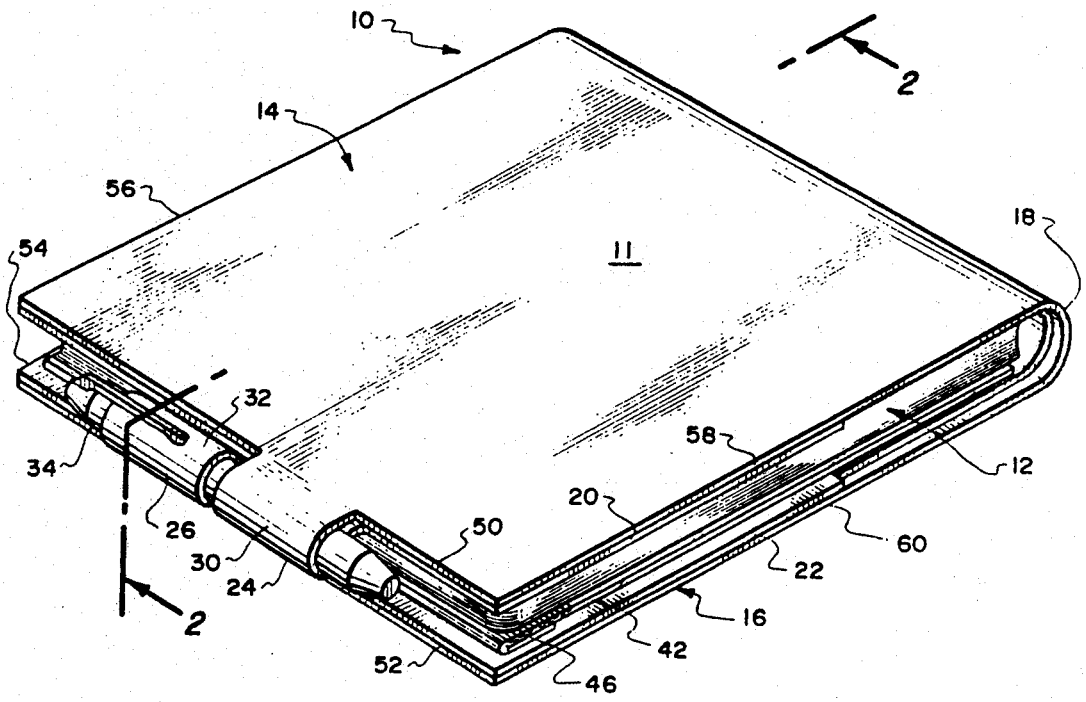
FIG. 1 is an isometric view illustrating the removable, protective cover of the invention disposed in operative relationship with a map book.
Figure 4:
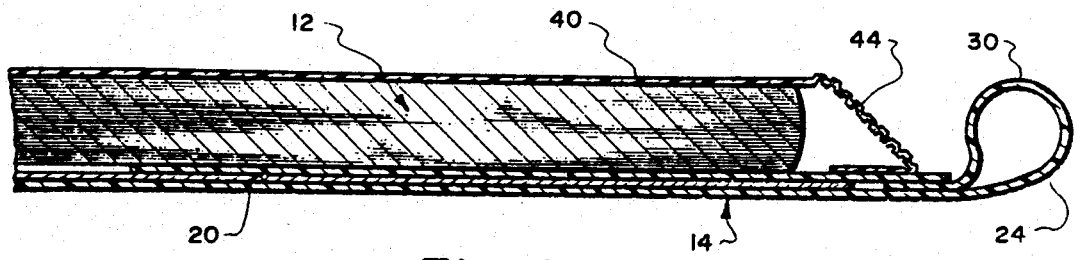
FIG. 4 is an enlarged fragmentary view taken from the broken line 4—4 of FIG. 3 illustrating the hinge interposed between the point of securement of the overlay and the overlay itself.
Figure 2:
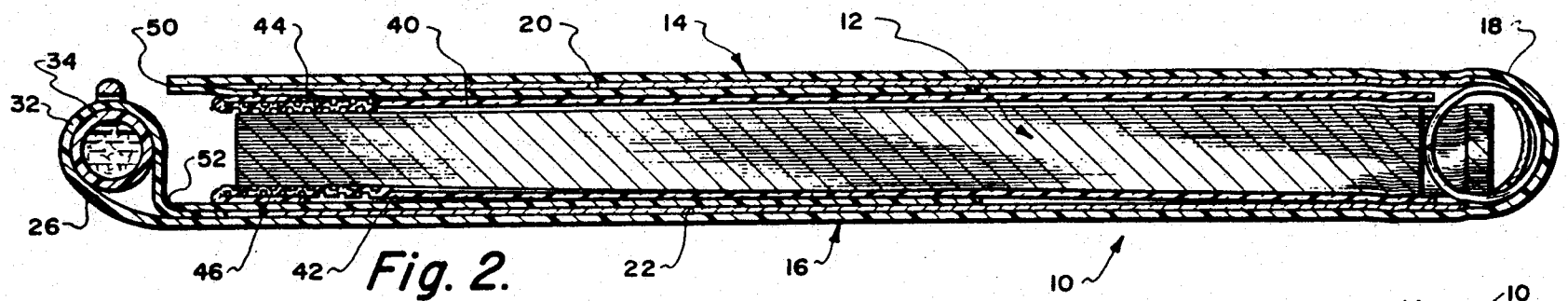
FIG. 2 is a transverse sectional view taken on the broken line 2—2 of FIG. 1.

Referring to the drawings, and particularly to FIG. 1 thereof, I show a preferred embodiment of a removable, protective book binding cover 10 constructed in accordance with the teachings of the invention and disposed in operative relationship with a map book 12 having an exterior binding. The cover 10 includes a jacket portion 11 having a front jacket section 14 and a back jacket section 16 with an intermediate section 18 therebetween. The jacket portion may be fabricated from various types of material including leather, plastic, and the like. Of course, the size and configuration of the cover 10 are dictated by the size and configuration of the book 12 with which the cover 10 is intended to be utilized. The jacket sections 14 and 16 have outer edges 50 and 52, respectively, and top edges 54 and 56 and bottom edges 58 and 60, respectively.

Operatively secured to the jacket portion 11 of the cover 10 are securement means constituted by pockets 20 and 22 fabricated from the same material as the jacket portion 11 and operatively secured thereto by stitching or other means of affixation. This affixation occurs along the outer edges 50 and 52, the top edges 54 and 56, and the bottom edges 58 and 60, respectively, of sections 14 and 16.

Tabs 24 and 26 are provided at the outer edges 50 and 52 in substantially cylindrical configuration to form loops 30 and 32, respectively. The loops 30 and 32 are so positioned at the edges 50 and 52 to facilitate the juxtaposition of adjacent extremities of the loops and axially align them when the book and cover are closed. This facilitates the insertion of a marking instrument such as a felt pen 34 in the loops, providing for both ready access to the pen and the utilization of the pen as a means of retaining the edges of the cover 10 in a closed configuration between periods of usage of the book.

Operatively mounted upon the pockets 20 and 22 are transparent overlay sheets 40 and 42 fabricated from vinyl or other appropriate material. The felt pen or other writing instrument can be utilized to inscribe on the overlays various notations relevant to juxtaposed pages of a map or other type of book in a manner to be described in greater detail below.

Hinges 44 and 46 are incorporated in the overlay sheets 40 and 42 adjacent the lines of affixation thereof to the jacket portion 11 of the cover 10. The hinges 44 and 46 facilitate the disposition of the respective overlays in intimate contiguity with the respective surfaces of the pages with which they are utilized to permit the imprinted material upon the surface of the pages to be readily perceived and the relevant notations to be inscribed on the overlays.

The hinges are, in the preferred embodiment, constituted by a juxtaposed series of striations formed in the overlay material which are parallel with the outer edges 50 and 52. The striations may be created by the utilization of heat-sealing or other means. The striations impart optimum flexibility to the hinges 40 and 46 to permit the said hinges to accommodate various thicknesses of superimposed pages of the book with which the cover 10 is utilized.

The installation of the cover 10 in operative relationship with a book 12, such as a map book, is accomplished by inserting the opposite edges of the book in the pockets 20 and 22.

The book 12 is then opened to the desired page, and an overlay sheet 40 or 42 is juxtaposed to the surface of that page. As noted previously, the overlays can be installed on opposite sheets or can be installed in operative relationship with an exposed sheet and another sheet which is to be subsequently used which is not exposed. As also noted previously, the hinge 44 or 46 permits the overlay sheet 40 or 42 to achieve operative contact with virtually the entire surface of the selected page, without the aforementioned gapping problems of the prior art.

Figure 3:
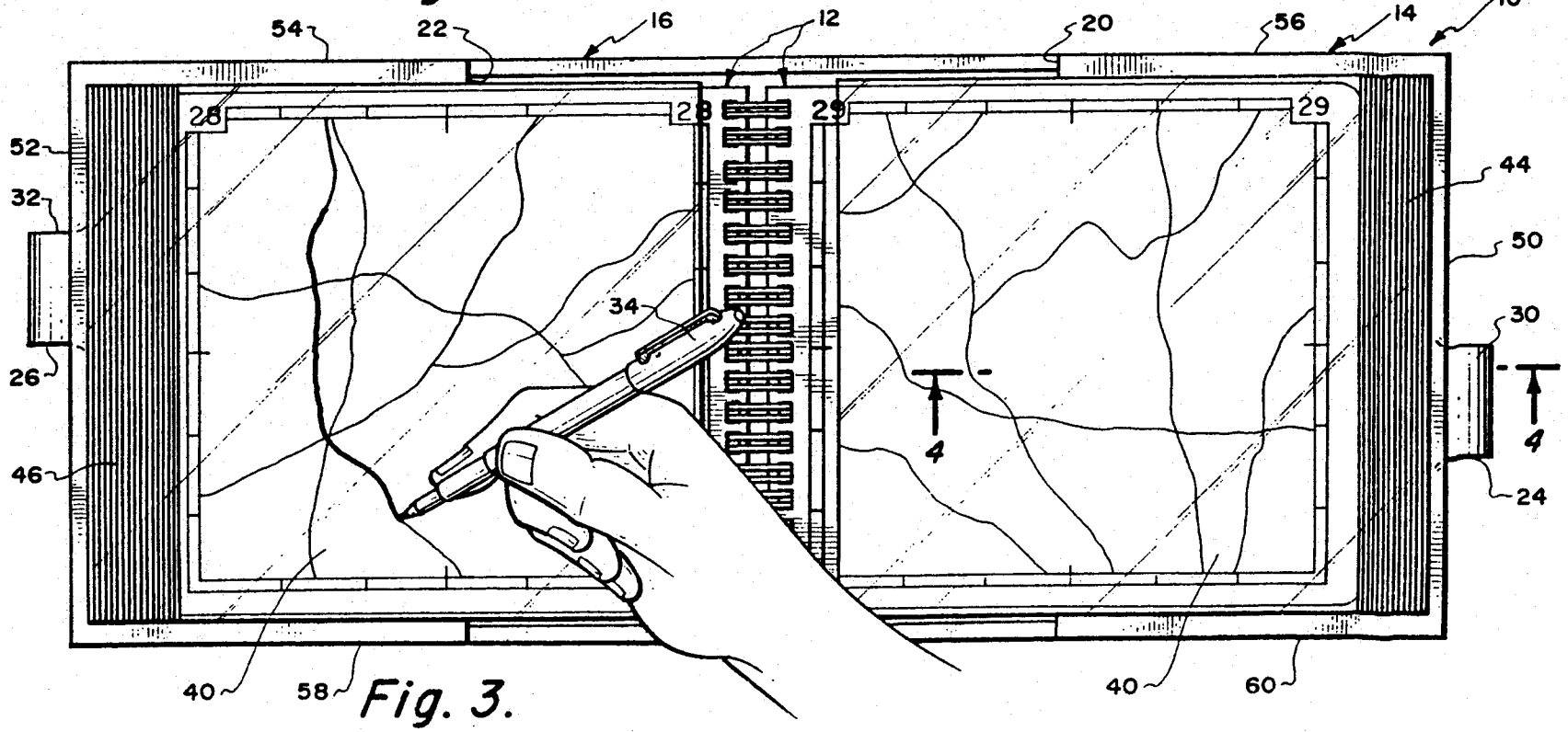
FIG. 3 is a top plan view showing the map book opened and the transparent overlays disposed in overlying operative relationship with the respective map sections of the book.

After the juxtaposition of the overlay sheets 40 and 42, the pen 34 or other writing instrument incorporating erasable ink may be used to trace a desirable travel path or other information from the map surface onto the overlay sheet, as best shown in FIG. 3 of the drawings. Additional information or other notes relevant to the journey may be inscribed on the overlay sheet, and information from more than one page of the map book may be also inscribed upon the specific overlay sheet. After the information on the overlay has served its purpose, it is erased and the overlay is ready to be utilized with another map section.

Of course, after the material or notations have been inscribed on the overlay, the book may be closed and the overlay serve as a book marker which will permit the book to be immediately opened to the desired page or map in the book.

Although I have described the removable, protective cover of my invention as being embodied in a specific configuration and as utilizing specific materials in the manufacture thereof, it will be obvious to those skilled in the art that other configurations and materials may be adapted to provide the same desirable results which will still fall within the scope of the appended claims.

I claim:

1. A removable, protective bookcover which covers an exterior binding of a book, comprising: an outer jacket portion for covering the exterior binding of the book; pockets on said jacket portion for removably securing said jacket portion to the exterior binding; and a protective transparent overlay secured to said jacket portion and adapted to overlie a page of the book, whereby relevant notations may be made on the surface of said overlay to create a record relevant to indicia appearing on the page, said overlay including hinge means facilitating the disposition thereof in contiguity to the surface of the page.

2. A removable, protective book-cover which covers an exterior binding of a book, comprising: an outer jacket portion for covering the exterior binding of the book; means for removably securing said jacket portion to the exterior binding; and a protective transparent overlay secured to said jacket portion and adapted to overlie a page of the book, whereby relevant notations may be made on the surface of said overlay to create a record relevant to indicia appearing on the page, said overlay including hinge means facilitating the disposition thereof in contiguity to the surface of the page, said book-cover further including retaining means for maintaining said bookcover in a desired closed, protective configuration when the book is not in use, in which said retaining means includes loops affixed to said cover and pen means slidably disposed through said loops.

3. The bookcover of claim 1 further includes retaining means for receiving a writing instrument whereby said bookcover may be maintained in a desired closed, protective configuration when the book is not in use.

4. The bookcover of claim 1 or claim 2 further including a plurality of said transparent overlays.

5. The bookcover of claim 2 in which said means for removably securing said jacket portion in operative relationship with said binding is constituted by pockets on said jacket portion engageable with the opposite edges of the exterior binding.

6. A removable, protective book-cover, comprising: an outer jacket portion for covering the exterior binding of a book; securement means operatively connected to said jacket portion for removably maintaining said jacket portion in operative relationship with the binding; and a transparent overlay secured to said securement means whereby said overlay can be disposed in operative relationship with a page of the book to permit temporary notations to be made upon said overlay relevant to contiguous printed matter on the page, said overlay incorporating hinge means adjacent the point of securement of said overlay to said securement means of said cover to facilitate the disposition of said overlay in intimate contiguity with the surface of the relevant page.

7. The cover of claim 6 in which a plurality of overlays is provided, one at each edge of said jacket portion to permit said overlays to be disposed in operative relationship with a plurality of pages of the book.

8. The cover of claim 6 or claim 7 in which said cover further includes retaining means for operatively retaining said cover in a closed position between periods of usage of the book.

9. The cover of claim 8 in which said retaining means includes loops affixed to said cover and pen means slidably disposed through said loops.

10. The cover of claim 6 or claim 7 in which said securement means is constituted by pockets located at opposite edges of said jacket portion and engageable with the opposite edges of the binding.

* * * * *